US005517808A

United States Patent [19]

Schleese

[11] Patent Number: 5,517,808

[45] Date of Patent: May 21, 1996

[54] SADDLE TREE

[76] Inventor: Jochen Schleese, 82 Derby Crt., New Market, Ont., Canada, L3Y 5Z9

[21] Appl. No.: 354,029

[22] Filed: Dec. 6, 1994

[51] Int. Cl.[6] ..... B68C 1/08

[52] U.S. Cl. ..... 54/44.6; 54/44.1; 54/44.5

[58] Field of Search ..... 54/44.1, 44.5, 54/44.6, 44.7, 45.1

[56] References Cited

U.S. PATENT DOCUMENTS

| | | | |
|---|---|---|---|
| 16,556 | 2/1857 | Spencer | 54/45.1 |
| 264,199 | 9/1882 | Sexton | 54/45.1 |
| 2,034,474 | 3/1936 | Knetsch | 54/44.7 |
| 3,911,648 | 10/1975 | Lightfoot | 54/44.5 |
| 4,860,524 | 8/1989 | Dumoulin et al. | 54/44.7 |

*Primary Examiner*—Robert P. Swiatek
*Attorney, Agent, or Firm*—Jane Parsons

[57] ABSTRACT

A saddle tree has asymmetric points to accommodate lodging against shoulder blades of a horse which are in nature themselves asymmetric. Suitably the points at least at their forward edges are shock absorbing to minimize the effect of concussion with the shoulder blades of the horse. An air pocket may be provided in the saddle to provide rider comfort in the pubic area and to guard rider from damage done by jolting and rubbing in the pubic area.

9 Claims, 7 Drawing Sheets

SADDLE TREE

BACKGROUND OF THE INVENTION

1. Field of the Invention

This invention relates to saddle trees on which saddles may be built. These saddles are usually used by riders or horses.

2. Description of the prior art

The art of making saddle trees is a very old traditional art which has not changed greatly with the advent of modern technology. Of course, some improvements have been made.

For example, a saddle tree, i.e., the frame work around which a saddle is built has traditionally been made from wood, preferably beech wood. The head, i.e., the front raised part of the saddle and the gullet, i.e., the arch under the head, are strengthened with steel plates and there is also steel reinforcement laid on the underside of the tree from the head towards the cantle, i.e., the back raised part of the saddle. Between the head and the cantle the saddle tree narrows as the waist. Points, i.e., downwardly extending arms from the head, extend downwardly to lodge behind the shoulder blades of the horse.

When a saddle is built on a saddle tree the rider sits with his or her seat bones on the seat between the saddle tree waist and the cantle. The rider's legs extend downwardly on either side of the horse approximately from the saddle tree waist.

The terms "head", "gullet", "waist", "cantle", "points" and "seat" are all conventional terms of the saddlery art and are used in their normal conventional meanings in this specification.

Although a saddle tree is traditionally made of beech-wood, many modern trees are now made of laminated wood bonded under pressure and formed in a mold. The laminated tree combines greater strength than beech wood with lightness but laminated wood may break when subjected to undue strains or when subjected to impact.

In order to obtain any appreciable resistance in the resulting saddle it is important that the framework be an open framework to allow for bending movement in the tree. Such bending movement is regulated by the springs. Rigid trees are possible but are undesirable. A rigid tree formed as a solid structure would be very heavy. For both laminated wood trees and beech wood trees, webbing may be tightly stretched across the open framework in the region where the rider will sit to form a firm base.

Even more recently universal nylon forms have become available. The saddler may use this to make various different shaped trees for similar forms. The nylon forms eliminate the need for webbing across the seat and are bendable, light and allow close contact of the rider with the horse's back.

These nylon forms are shaped by the saddler to the shape he requires by trimming and by the use of rigid gullet plates and/or head plates and by spring steel reinforcement which runs longitudinally from head to cantle. The gullet plate may be formed generally in the form of an arch the legs of which extend downwardly and rigidly into the points. The upper surface of the nylon base may be cushioned in various manners to make it comfortable for the rider.

The saddler must consider both the anatomy of the horse and the anatomy of the rider when making a saddle. Moreover, he must take into account the fact that, if the rider is to transmit body language messages to the horse, the rider must have close contact with the horse. Particular problems that are encountered are:

Rider

The weight of the rider should be evenly carried on the ischial tuberosities or seat bones and balanced by contact with the saddle through the pubic bone. Thus the rider's seat is a three point seat although the weight is normally carried by only two of them. Commands to the horse are given not only through the rider's hands to the bridle reins but also through the rider's legs and seat bones. The contact with the pubic bone is along a vertical ridge through which the head merges through the seat with the cantle. Pressure or rubbing in the pubic area can lead to various medical difficulties.

Horse

When walking or trotting the range of movement of the horse's shoulder blade or scapula in the longitudinal direction, i.e., from front to rear and vice versa, is very great. The scapula is connected with the humerus at the point of the shoulder at an angle of somewhere in the region of 90 degrees. When the horse takes step forward this angle increases greatly as the humerus becomes more vertical to press the scapula rearwardly, the flat blade-like portion of the scapula can slide under the respective point of the saddle on a tree by an appreciable amount. This tends to produce a twisting motion of the saddle according to the movement of the horse.

Another difficulty in fitting the saddle to the horse results from the essential asymmetry of the horse. It is important that the saddle, when the horse is standing squarely, is lodged on the horse at three essential locations, these being locations abutting the shoulder blades on either side and a composite location balanced to either side of the spine above the rib cage towards the loins. Unfortunately, due to both skeletal and muscular development, the shoulder blades of the horse are rarely symmetrical. The degree of asymmetry may or may not alter during training of the horse.

The saddler's problems are, therefore to design a saddle which allows full contact of the rider's pubic bone with the saddle to allow balance but does not cause undue pressure against the rider's pubic bone even under jolting; to design a saddle to allow for the asymmetry of the horse's shoulder blades and the potential changing asymmetry of the horse's shoulder blades; and to provide some degree of shock absorbtion against movement of the shoulder blades against or under the front of the saddle.

The first problem, i.e., the achievement of a three point seat by the rider on both seat bones and the pubic bone without subjecting the pubic bone to undue pressure, is not a small problem. Contact and jolting of the rider in the pubic area can cause severe discomfort to the private parts either due to jolting or due to rubbing. The problem is very real for both sexes but it may be female riders who are at greater medical risk. The pubic bone of women is lower than in men and any effect of jolting on the pubic bone itself may therefore be greater. Rubbing or jolting of a hard ridged part of the saddle against a woman's private parts may also lead to severe gynaecological problems such as general soreness, vaginal bleeding and vaginal and bladder infections due to the presence and constant rubbing in the presence of any bacteria present.

Some riders have attempted to solve the problem individually by utilizing several layers of thick underwear and possibly sponge or foam located between them. This, however, reduces useful contact with the saddle and ultimately with the horse.

One saddle has been designed with an actual see through aperture through the entire saddle but this is unsatisfactory since there is no provision for any contact of the pubic bone with the saddle to provide for balance. The rider's balance and weight is thrown onto the seat bones, leading to discomfort and imbalance, instead of ditribution on three points. In upper levels of riding in any discipline, this lack of balance is totally unacceptable.

In conventional saddles which are generally available points of the saddle tree are always symmetrical and usually either slope slightly forward or, at least, do not slope rearwardly. The present applicant has already designed a saddle tree in which the points are directed slightly towards the rear. The purpose of designing the points in this manner was to mitigate the concussion of the shoulder blades of the horse against the hard edges of the points during at least walking and trotting of the horse. In fact, although padding is used when the saddle is built on the tree, the hard form of the points may still cause appreciable concussion against the shoulder blades. The present applicant found that sloping the points rearwardly only alleviated the problem but that further shock absorbing effect would be desirable.

The present inventor has also addressed the problem of the asymmetry of the horse. When a foal lies in the uterus of its mother, one foreleg, usually the right foreleg is wrapped outside the body and around the other foreleg which is held closely to the body. Thus, the shoulders of the embryo are located unevenly with greater potential for development for one of them. When the foal is born it is already one sided. The left shoulder muscle may already be appreciably larger than the other. In the early years of the life of the foal this is accentuated by muscle growth. The young animal tends to take more exercise using its stronger side. This stronger side continues to develop unevenly to the detriment of the other side. By the time the young animal is put into training it is probably one sided in both muscle development and bone growth.

This presents a problem about which there are conflicting points of view. One group of equine professionals takes the view that by training and therapy directed principally to the less strong side of the horse, evenness can eventually be achieved. The other group of equine professionals points to the uneven bone growth and accepts that some degree of unevenness will always remain. Both groups of professionals appear to be in agreement that the degree of asymmetry can be affected by training to change it to some extent.

At first sight therefore, it would appear that there is little that can be done about this problem by means of equipment. Nevertheless, conventional saddles having trees with symmetric points may tend to twist when the horse walks or trots since the action of one shoulder blade against its respective point is not the same as the action of the other shoulder blade against its respective point. Due to the shape of the saddle itself, the broader seat beyond the waist the seat of the rider may be subjected to a twisting motion as the saddle moves almost like a corkscrew on the horse's back.

SUMMARY OF THE INVENTION

The present inventor, surprisingly, when considering the two problems arising from concussion of the shoulder blades against the front of the saddle and the asymmetry of the horse's shoulder blades, devised a saddle tree having asymmetric points with adjustable shock absorbing leading edges. It should be noted, that while a saddle tree having asymmetric points with adjustable, shock absorbing leading edges may solve both the above stated problems concerning the horse's anatomy, either a saddle with asymmetric points may present distinct advantages or a saddle with shock absorbing leading edges may also provide distinct advantages. It is not necessary that these two features be combined.

Moreover, the present inventor also devised a saddle having a continuous saddle surface to provide a contact area for the pubic bone but also having an air pocket under the continuous surface to release pneumatic pressure immediately on undue pressure from the pubic bone to soften the surface of the saddle in that region.

Accordingly the invention provides a spring saddle tree having a resilient unitary base form, points of the tree being asymmetric in forward and rearward directions. The points of the tree may be offset in the forward-rearward direction by an amount equal to a degree of asymmetry between the shoulder blades of a horse for which the saddle tree is intended. For example, the points, at their distal ends, are offset in the forward rearward direction by from 0.75 inch to 3 inches, or preferably by from 1 inch to 2.5 inches.

Shock absorbing material may preferably be provided at the leading edge of the points. This shock absorbing material may be utilised to provide the required asymmetry. For example, trailing margins of the points may be symmetrical in the forward-rearward direction, asymmetry being provided by shock absorbing material of differing widths on the leading edge of each one of said trailing margins. The shock absorbing material may be double layer of resilient sheet material, e.g., leather, forming a pocket around the leading edge of said trailing margin.

An air pocket may be provided in an aperture of the unitary base form, and located to lie under the position of a rider's pubic bone, the air pocket being located to at least partially void on pressure from said pubic bone. The pocket may be bounded below said aperture by a backing sheet in a gullet of the base form and above said aperture by a layer of closed cell foam. The backing sheet is connected to the gullet in a manner to allow for leakage of air out of said air pocket.

BRIEF DESCRIPTION OF THE DRAWINGS

Embodiments of the invention will now be described by way of example with reference to the drawings, in which.

DETAILED DESCRIPTION OF A PREFERRED EMBODIMENT

Figure 1:
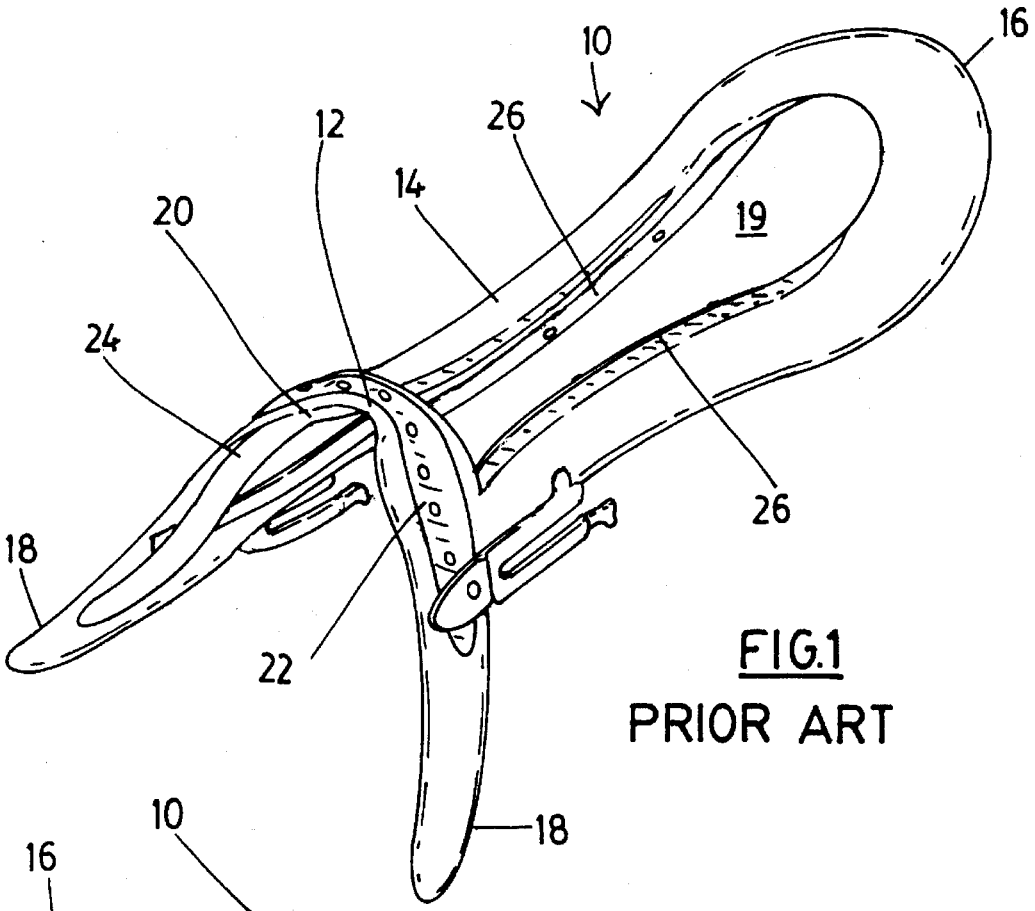
FIG.1 PRIOR ART
FIG. 1 is a perspective view of a prior art saddle tree generally seen from above.
Figure 2:
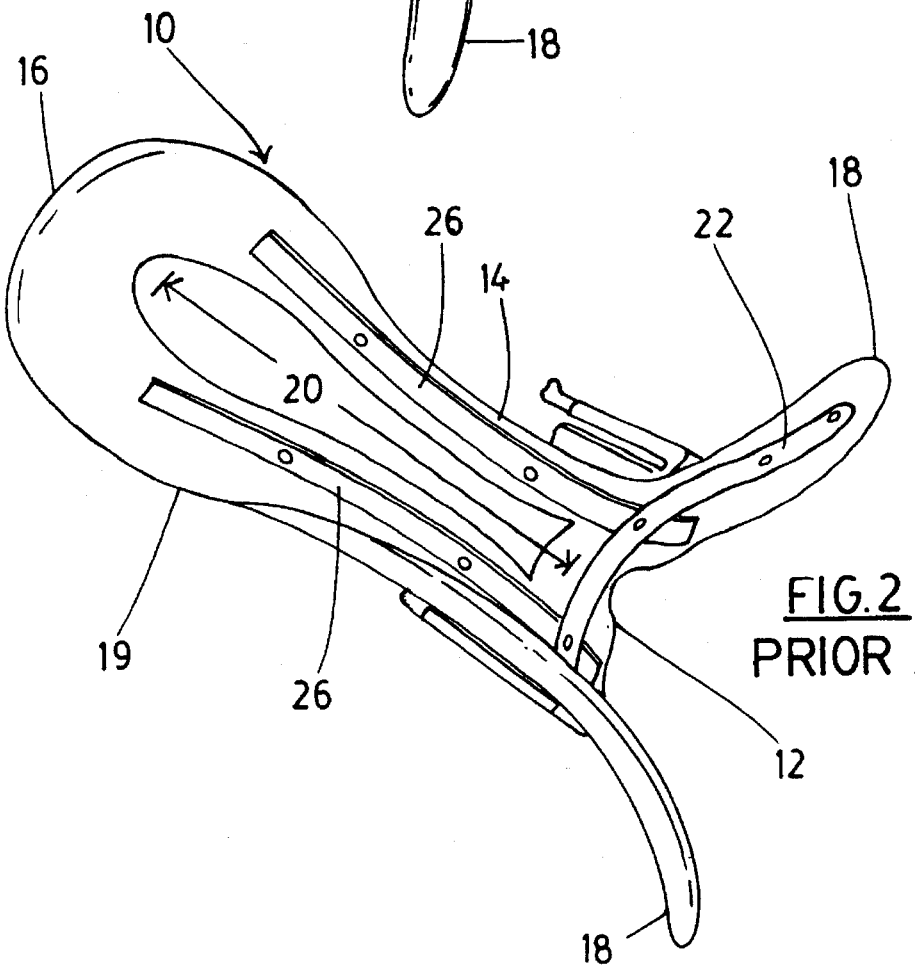
FIG.2 PRIOR ART
FIG. 2 is a perspective view of the saddle tree of FIG. 1 generally seen from below.
Figure 3:
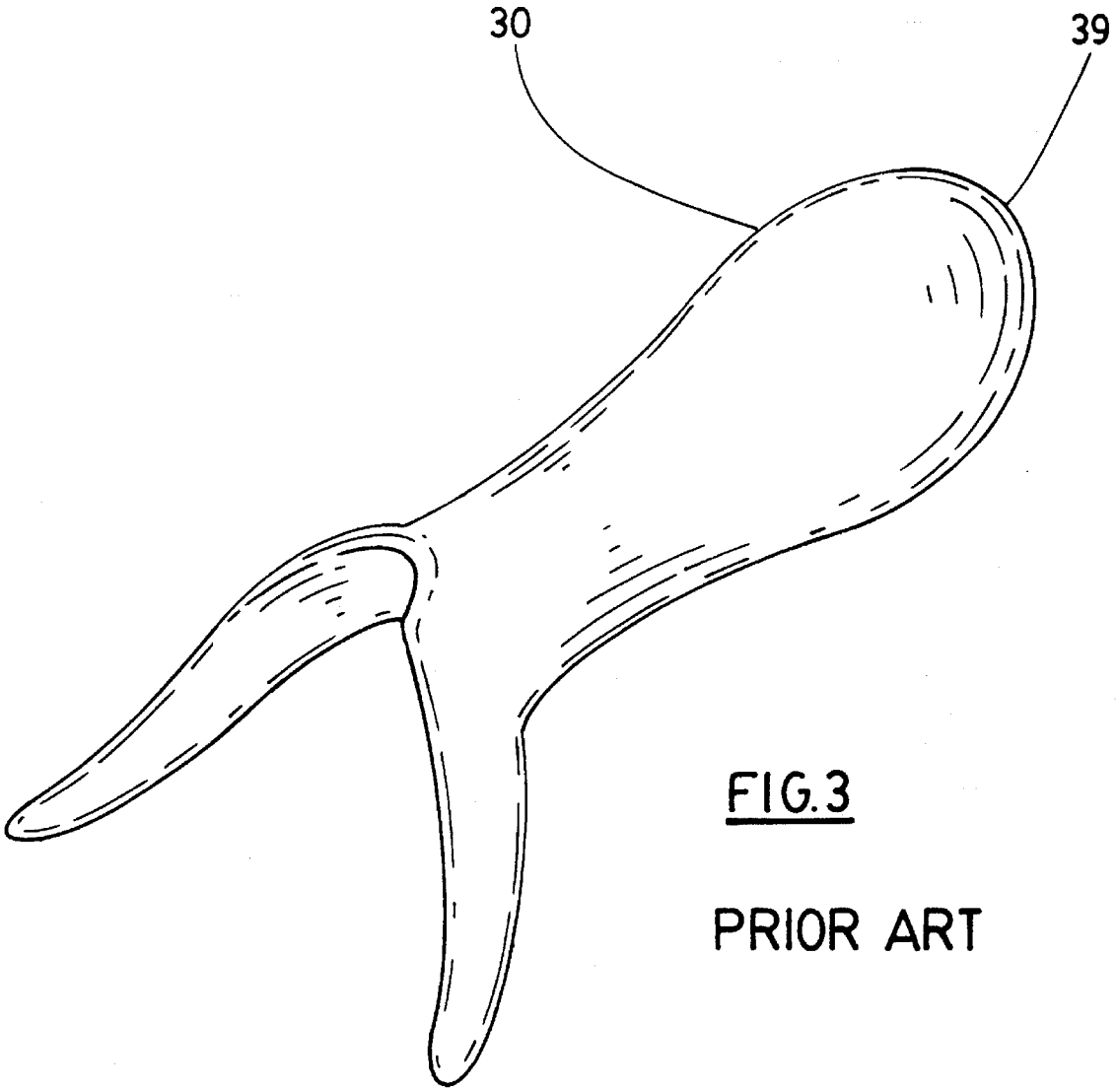
FIG. 3 PRIOR ART
FIG. 3 is a view of a nylon base of a more recent prior art now used to build varying different saddle trees.

FIG. 1 and 2 illustrate a prior art saddle tree 10 having a head 12, a waist 14, a cantle 16, points 18, a seat 19, and gullet channel 20. Such a saddle tree might be made of wood or of laminated wood. Rigid reinforcement plates such as steel plates may be present as the head plate 22 and/or gullet plate 24. Longitudinal springs 26 are present usually formed of spring steel.

The saddle tree 10 includes prestrained webs (not shown) fastened tightly from the head 12 to the cantle 14 to form a foundation. Over the webbing stretched canvas or other fabric are provided to form a hard base for the seat 19. For this traditional type saddle tree the open framework between head and cantle is necessary to allow for some resilience of the tree as controlled by the springs 26.

More recently, but still conventionally, a seat base form 30 formed of a resilient material such as nylon has largely replaced the traditional wooden framework. A nylon seat base form 30 may be molded in a universal mold for nearly any shape of saddle. The resulting seat base may be trimmed by the saddler in order to form a suitable base for varying different types of saddle tree which he requires. A seat base form 30 must be provided with a head plate and/or gullet plate and springs. Since the nylon material form is naturally resilient it is not necessary to provide an open framework similar to the wood framework shown in FIGS. 1 and 2. Thus, the base form 30 may include a molded seat 39. Such a form is a versatile modern aid to the saddler and is comparable to the open framework in FIGS. 1 and 2 when it has been provided with stretched webbing and canvas to provide a firm seat base.

It is worth noting at this point that in conventional saddle trees of the type of saddle tree 10 and trees based upon the resilient nylon base form 30, the points may tend to be directed forwardly. The reason for this is for ease in building a saddle onto the tree which will clear the withers of the horse. It is possible to provide a saddle tree where the points are directed straight downwards but, at least for some horses or for some types of saddle, it is necessary to cut away the tree at the head to give clearance for the withers. Nevertheless, while forwardly directed points may allow for building a tree which may be used as a base for a non-customized saddle to fit a variety of horses, such forward direction of the points is undesirable for other reasons concerning concussion of the shoulder blades thereagainst.

Figure 4A:
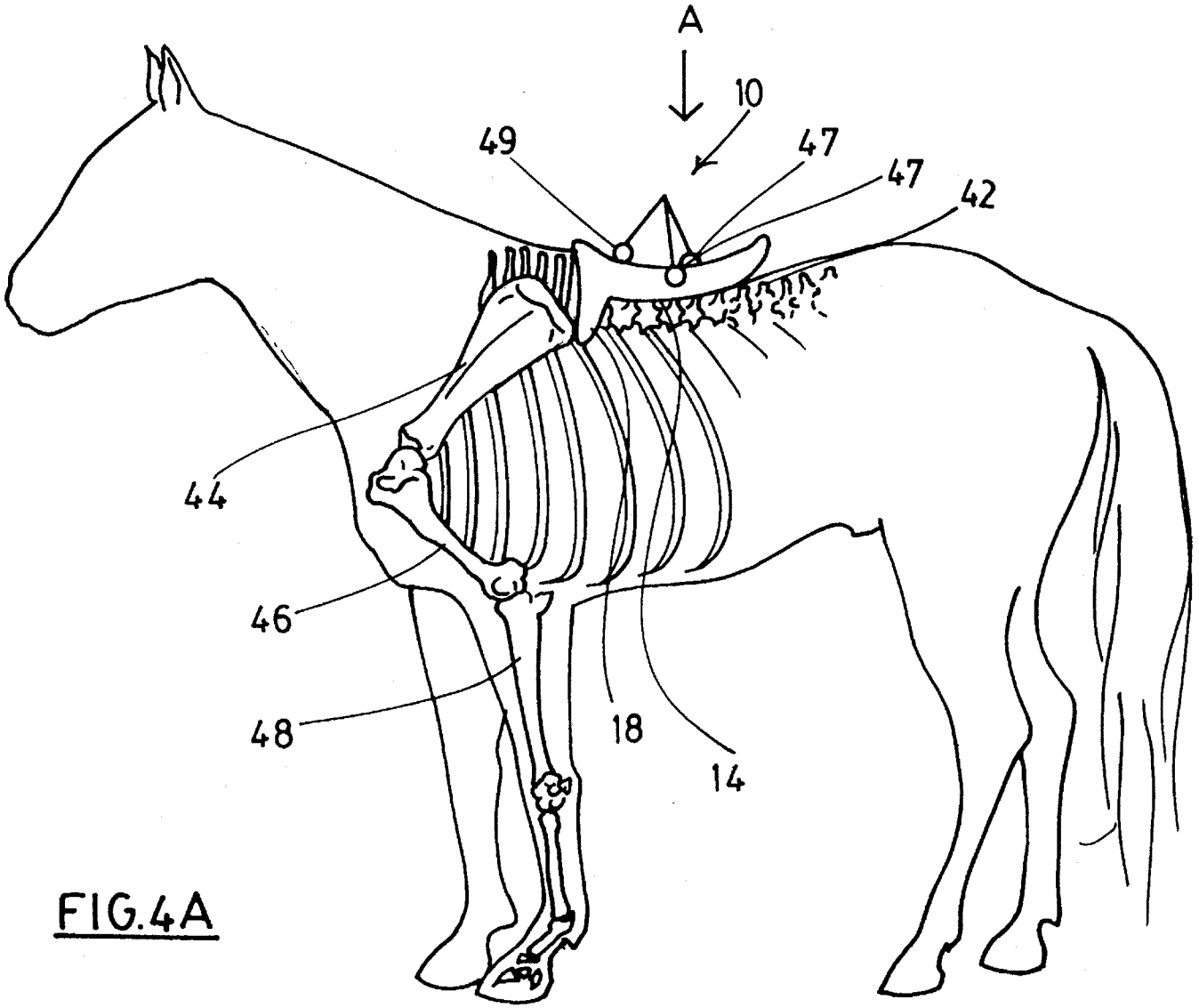
FIG. 4A, 4B, 4C are sketches indicating mechanical problems that arise with conventional saddle trees for both horse and rider.
Figure 4B:
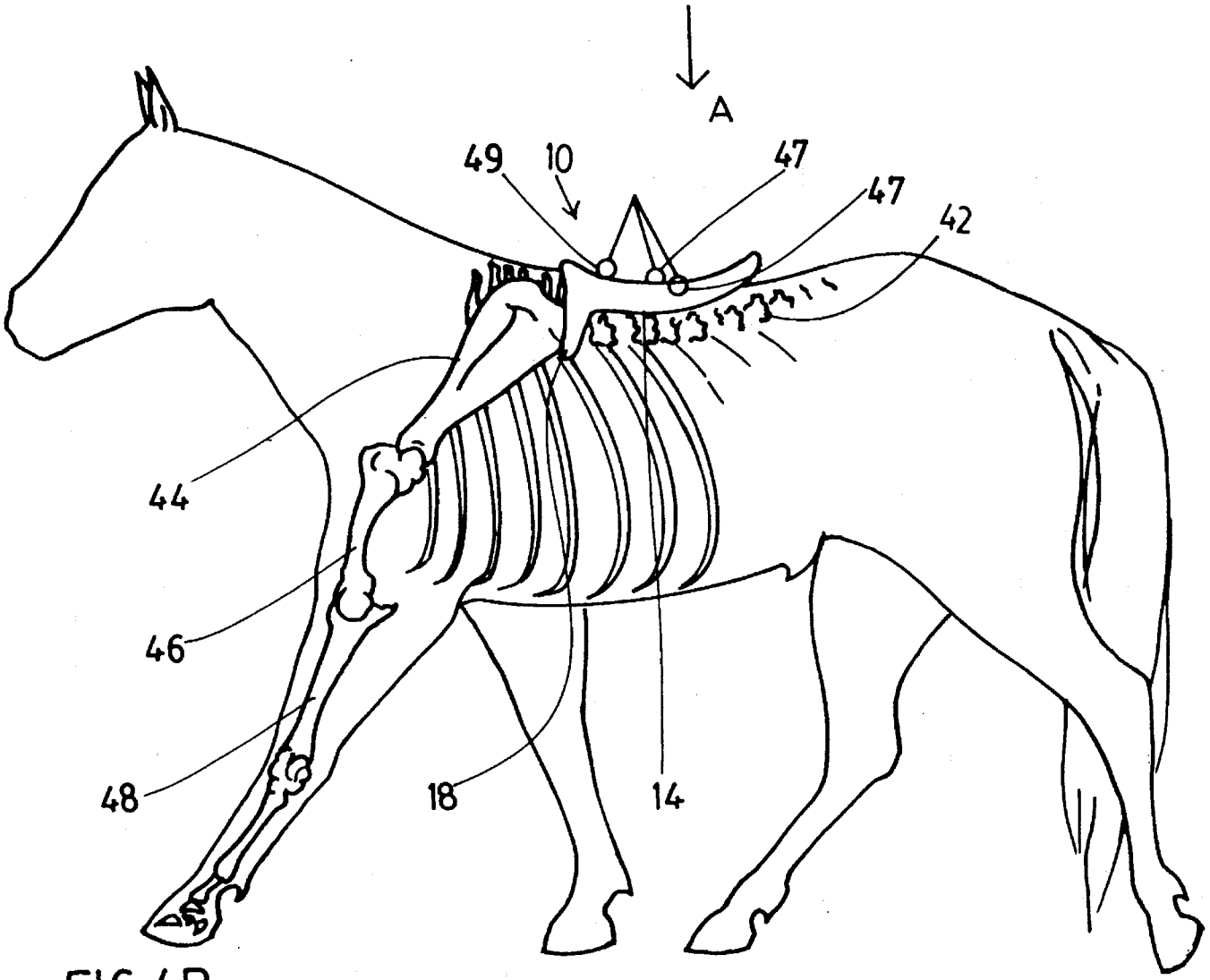
Figure 4C:
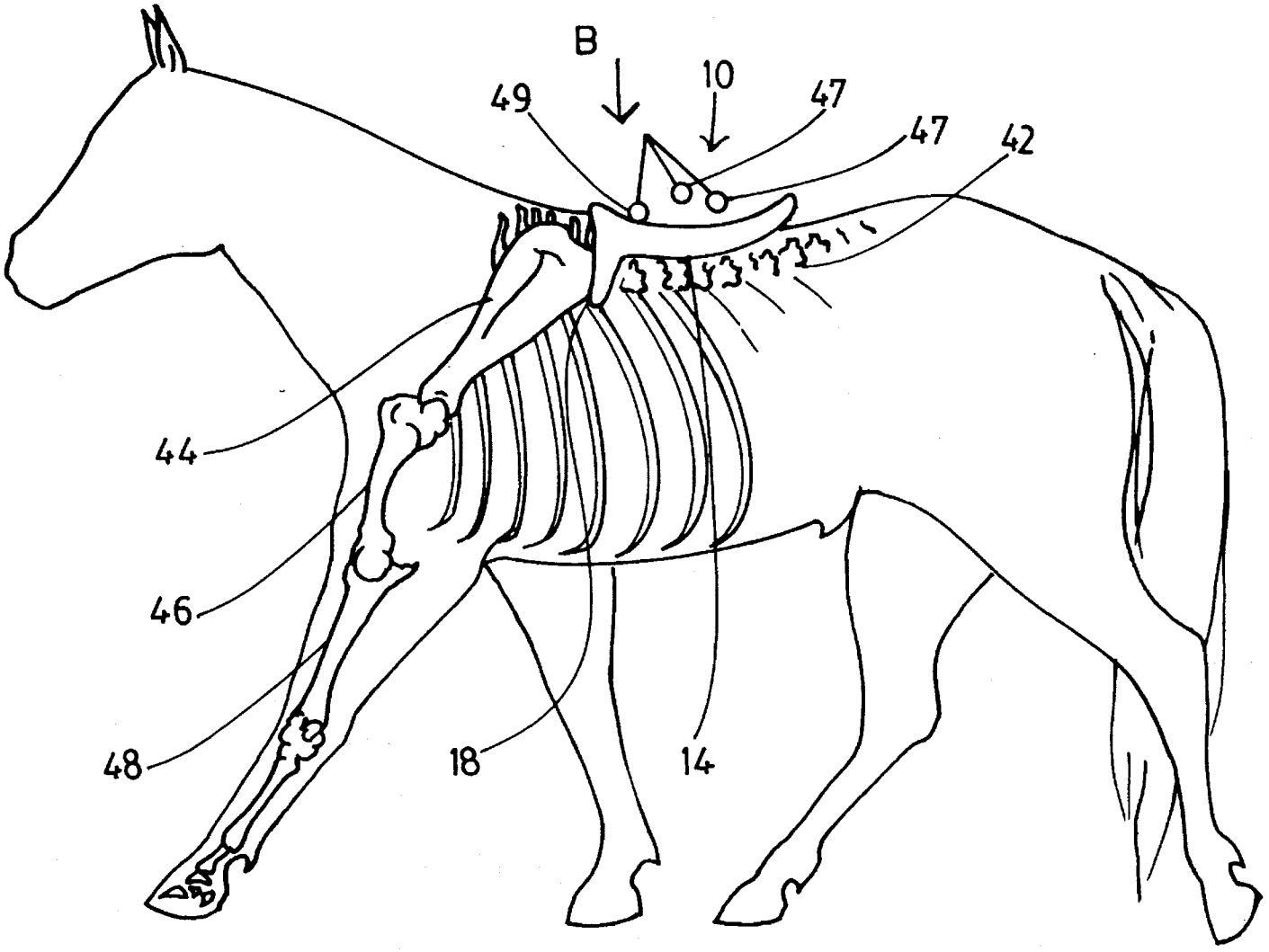

FIGS. 4A, 4B and 4C illustrate some of the problems that arise.

FIG. 4A schematically shows the saddle tree 10 located on the back of the horse. Parts of the horse skeleton including the spine 42, the scapula or shoulder blade 44, the humerus 46 and the ulna 48 are indicated. The horse is standing with its foreleg and ulna 48 generally vertical. The seat region of the skeleton of a rider is indicated showing the pressure on saddle tree 10. The ischial tuberosities 47 of the rider's seat bones are located to either side of the horse's spine 42 rearwardly of the waist 14 of the tree 10 and forwardly of its cantle 16. The pubic bone 49 of the rider contacts the saddle at an uppermost ridge of the tree generally in the waist region. Most of the weight of the rider should be directed in the direction of arrow A and falls on the seat bones. Nevertheless, the contact of the pubic bone 49 on the saddle is extremely important for balance.

FIG. 4B shows the relative change in position of the ulna 48, the humerus 46 and the shoulder blade 44 when the horse takes a step forward. The lower end of the ulna 48 moves forwardly so that the ulna 48 extends at an angle to the vertical. The humerus is, as a result, moved into a more vertical position so that the point of the shoulder does not project so prominently forwardly. Indeed, the top end of the humerus moves rearwardly and slightly upwardly due to the more vertical position of the humerus. The result is that the shoulder blade 44 has its lower end moved slightly upwardly and rearwardly to tilt the flattened blade portion of the shoulder blade downwardly and rearwardly to either jolt hard against the points 18 or to move underneath them as shown. In either event, the saddle may tend to twist on the horse's back.

FIG. 4C shows the state of affairs when the rider tilts forwardly. The weight is suddenly in the direction of arrow B so that it falls largely on the pubic bone 49. This may cause various medical problems for both sexes.

Figure 5:
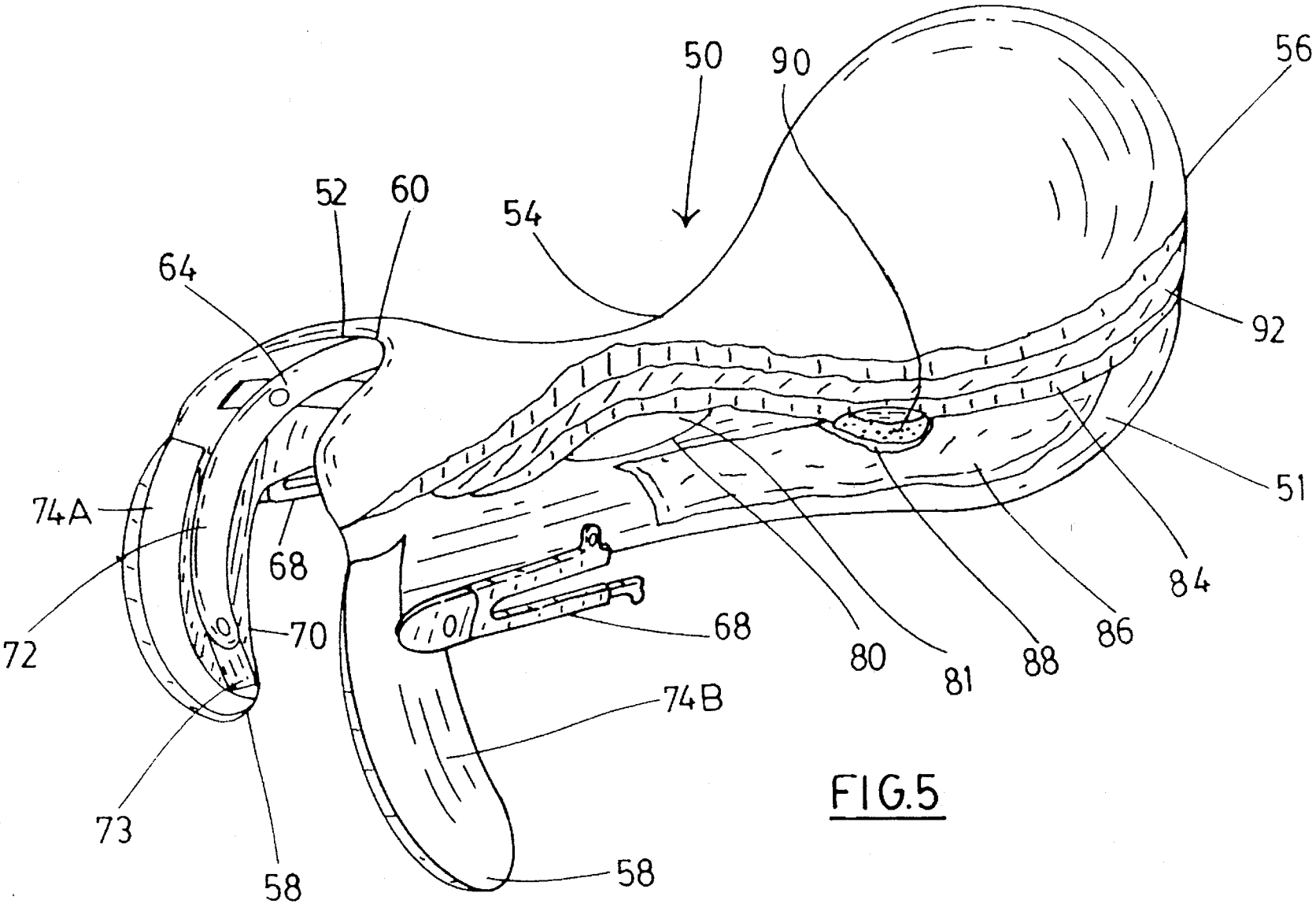
FIG. 5 is a perspective view of a saddle tree of the present invention as seen from above.
Figure 6:
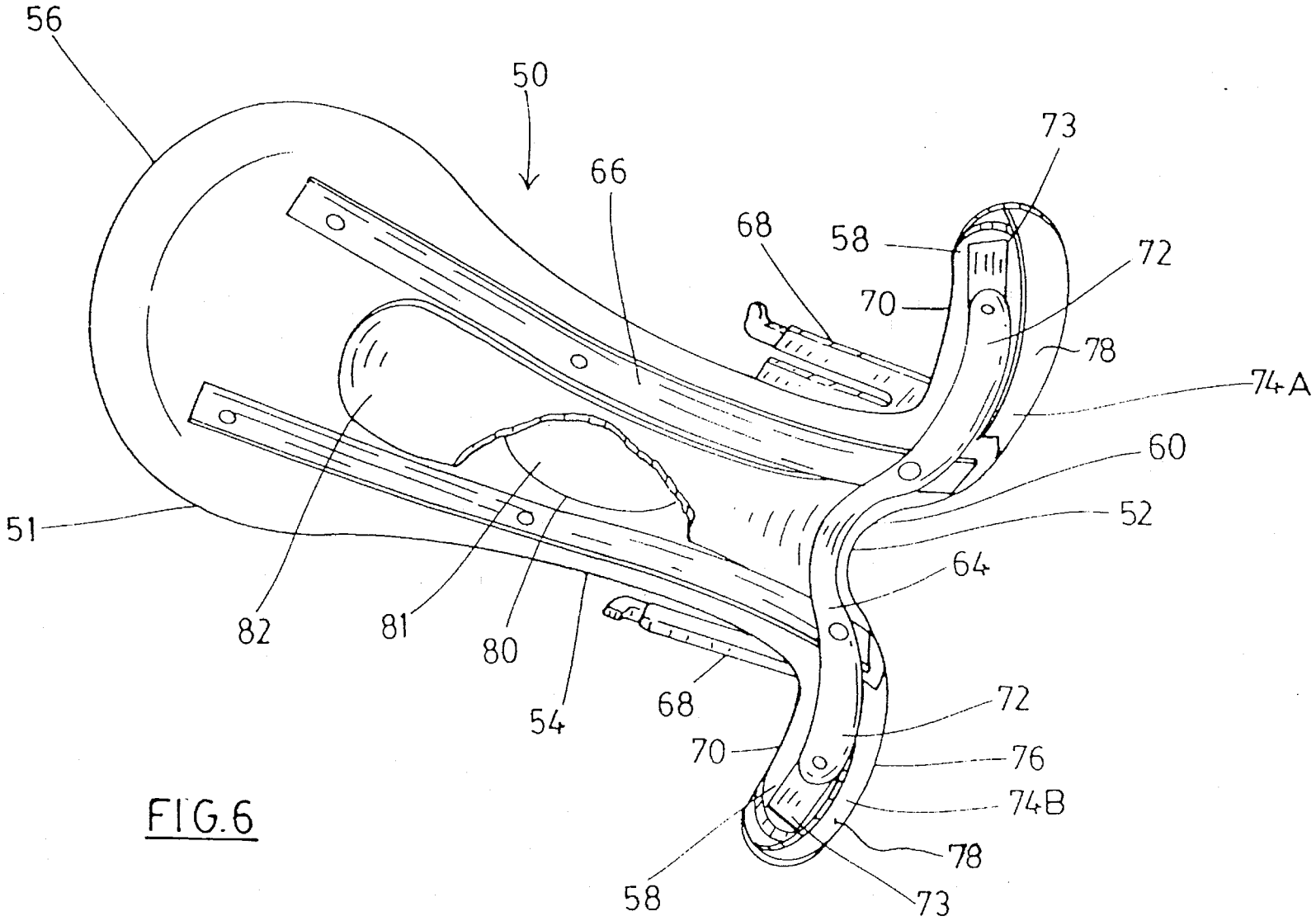
FIG. 6 is a perspective view of the saddle tree of FIG. 5 as seen from below.

FIGS. 5 and 6 illustrate one embodiment of a saddle tree 50 according to the invention. Tree 50 has head 52, waist 54, cantle 56, points 58. Generally U-shaped gullet plate 64 arches upwardly into gullet 60 and its legs 72 extending downwardly into the trailing margins of points 58. The legs 72 of the gullet plate may be provided with extension 73 of spring steel to allow for greater resilience at their distal ends. Springs 66 formed of spring steel, extend rearwardly from gullet plate 64 to just forward of the cantle 56. Suitably a resilient nylon saddle tree base form 51 may be used.

The gullet plate 64, while generally formed as a U-shape, is shaped so that the arched web portion is extended somewhat rearwardly, and the leg portions reinforcing the points 58, are also directed rearwardly to alleviate some of the concussion between the shoulder blade of the horse and the points. Thus, the gullet plate 64 has a forward curve located generally at the most forward point of the saddle which may be around or just above the level at which stirrup leather bars 68 are located. The nylon seat base 51 may be trimmed so that the points are similarly directed rearwardly to provide other characteristics required by the saddler.

As may be more easily seen from FIG. 6, the points 58 comprise a trailing margin 70 along which the nylon seat base is firmly fixed to the legs 72 of gullet plate 64 and the extension 73, if present. Resilient, trimmable, shock absorbers 74A, 74B are applied along at least a part of the length of the leading edge 76 of the points of nylon seat base 51.

The shock absorbers 74A, 74B may be formed of any suitable shock absorbing sheet material. It may be fashioned as a double layer to form a pocket around leading edge 76 of the point of the nylon base form and to extend forwardly therefrom to form the leading margin 78 of respective point 58. The outer layer may extend rearwardly to cover the whole point 58 to provide a smooth surface for building the saddle and to provide anchor points for anchoring the shock absorber to the point. One suitable material from which shock absorber 74 may be made is leather. Nylon plates covered with gel, sole rubber or foam may also be utilized.

While leg 72 of gullet plate 64 may be directed in similar rearward directions so that the gullet plate 64 itself is symmetrical, the leather shock absorbers 74 which extend generally along the length of the leading edge 76 of the points of the nylon base form 51 are preferably not symmetrical. The shock absorber 74A of the point 58 on the less developed side of the horse may be wider than the shock absorber 74B of the point 58 on the more greatly developed side of the horse. As a result, the front edges of the shock absorbers 74A and 74B may each be lodged against respective shoulder blades of the horse even though those shoulder blades are themselves asymmetric. If the shock absorbers 74A and 74B do not actually abut the shoulder blades they will lie similar distances from their respective shoulder blades. The difference in width of shock absorbers 74A and 74B is dependent upon the degree of asymmetry of the horse's shoulder blades. Thus, in an extreme and unlikely example where the horse's shoulder blades are 5 inches or more asymmetric, then the width of shock absorber 74A may be 5 inches greater than shock absorber 74B. A more realistic example of width difference between shock absorber 74A and 74B may be that shock absorber 74A is from 0.75 of an inch to 3 inches greater than the width of shock absorber 74B. Preferably, and even more realistically, the width of shock absorber 74A may be from 1 to 2.5 inches greater than the width of shock absorber 74B. It should, however, be noted that these ranges are for guidance only. The width of the shock absorber at their distal ends is dependent of the difference in position of the shoulder blades of the horse.

As indicated previously, there is difference in opinion among equine professionals as to what corrective action may be taken concerning the asymmetry of the horse. If it is true that the asymmetry may be corrected through intensive training designed to develop the less developed side of the horse, the saddle tree 50 illustrated in FIGS. 5 and 6 may be adjusted as the horse improves. It is a simple matter to disassemble that part of the saddle built onto the tree and trim back the wider shock absorber as required. Of course, the shock absorbers should be made of material which is both easily trimmable by a knife or a rasp and which absorbs jolts and shocks as well. That part of the shock absorber which extends forwardly of leg 72 of gullet plate 64 and leading edge 76 of nylon base 51 will comprise two layers of the sheet material, trimmable, shock absorbing material. These layers forward of leading edge 76 of nylon base 51 may suitably be adhered together by any suitable adhesive or otherwise fixed together to form a unitary structure. The trailing edges of each shock absorber 74 may lie to either side of leading edge 76 of nylon base 51.

In order to provide for rider comfort and to guard against concussion or pressure damage to either the pubic bone or the rider's private parts, an air pocket having means for release of pressure from within it may be provided. An aperture 80 is provided in base form 51 in the general area of the waist 54 where pressure from a rider's pubic bone is to be expected. The aperture 80 is backed by a closure sheet 82 in the gullet of base form 51. This closure sheet 82 is fixed to the gullet surface to allow for air leakage between the gullet surface of base form 51 and the backing sheet 82. Thus, adhesive is not used to fix backing sheet 82 to the gullet surface. Staples may be suitable. The backing sheet 82 is formed of leather.

On the other side of the tree 50 above aperture 80, a layer of foam 84 is applied. This foam may be closed cell foam such as polyurethane closed cell foam, such as Alveolite (trademark). This foam 84 seals the aperture 80 from above and provides a comfortable base for the rider to sit on.

An air pocket 81 is formed in aperture 80 between the backing sheet 82 and the foam layer 84. Around the margin of the nylon base 51 a layer of felt 86 is applied under the foam 84 and, where the seat bones of the rider are expected to be located, cut out areas 88 are formed in the felt and these are filled with high density foam 90 as a cushion for the seat bones. On top of the foam a layer 92 of Neoprene is applied. The Neoprene layer 92 provides some fluid motion in lateral directions to allow for some change in position of the rider.

In practice, if the rider tilts forward so that the weight is directed in the direction of arrow B of FIG. 4C, pressure will be exerted in the region of the air pocket 81 formed between the Alveolite foam layer 84 and the backing sheet 82 on the gullet surface through aperture 80. If the pressure is more than mere contact of the rider's pubic bone with the saddle, air will be at least partially voided from the air pocket between the gullet surface and the backing sheet 82. When the pressure is relieved, air will be drawn back in. It may be desirable in some circumstances to provide a quantity of open cell foam within the aperture 80 between the backing sheet 82 and the Alveolite layer 84.

It is believed that the provision of the air pocket maintains full rider contact with the saddle without exerting undue pressure on the rider in circumstances that would otherwise jolt the pubic bone or the private parts. Moreover, the aperture 80 is not only relatively small, i.e., of sufficient size to accommodate an air pocket in the region of the pubic bone, but need not detract from the unitary structure of seat base form 51 and thus from the strength of the resulting saddle.

I claim:

1. A spring saddle tree having a resilient unitary base form, points of the tree being asymmetric in forward and rearward directions in which trailing margins of the points are symmetrical in the forward and rearward directions asymmetry being provided by shock absorbing material of differing widths on the leading edge of each one of said points, the shock absorbing material being a double layer of resilient sheet material forming a pocket around the leading edge of each of said points.

2. A spring saddle tree as claimed in claim 1 in which the points of the tree are offset in the forward-rearward direction by an amount equal to a degree of asymmetry between the shoulder blades of a horse for which the saddle tree is intended.

3. A spring saddle tree as claimed in claim 1 in which the points at their distal ends are offset in the forward-rearward direction by from 0.75 inch to 3 inches.

4. A spring saddle tree as claimed in claim 3 in which the points at their distal ends are offset in their forward-rearward direction by from 1 inch to 2.5 inches.

5. A spring saddle tree as claimed in claim 1 in which the points are angled rearwardly.

6. A spring saddle tree as claimed in claim 1 in which the shock absorbing material is leather.

7. A spring saddle tree as claimed in claim 1 in which an air pocket is provided in an aperture of the unitary base form, and located to be under the position of a rider's pubic bone, the air pocket being located to void at least partially on pressure from said pubic bone.

8. A spring saddle tree as claimed in claim 7 in which said pocket is bounded below said aperture by a backing sheet in a gullet of the base form and above said aperture by a layer of closed cell foam.

9. A spring saddle tree as claimed in claim 8 in which said backing sheet is connected to the gullet in a manner to allow for leakage of air out of said air pocket.

* * * * *